US008931408B2

(12) United States Patent
Ruskofsky et al.

(10) Patent No.: US 8,931,408 B2
(45) Date of Patent: Jan. 13, 2015

(54) SOCK IDENTIFICATION KIT

(76) Inventors: Debi N. Ruskofsky, Clovis, CA (US); Kyle D. Ruskofsky, Clovis, CA (US)

( * ) Notice: Subject to any disclaimer, the term of this patent is extended or adjusted under 35 U.S.C. 154(b) by 732 days.

(21) Appl. No.: 13/196,957

(22) Filed: Aug. 3, 2011

(65) Prior Publication Data

US 2012/0031292 A1 Feb. 9, 2012

Related U.S. Application Data

(60) Provisional application No. 61/370,204, filed on Aug. 3, 2010.

(51) Int. Cl.

| | |
|---|---|
| ***B41K 1/56*** | (2006.01) |
| ***B44B 11/04*** | (2006.01) |
| ***B41K 1/04*** | (2006.01) |
| ***B41K 1/50*** | (2006.01) |
| ***B41K 1/58*** | (2006.01) |

(52) U.S. Cl.

CPC ... *B41K 1/04* (2013.01); *B41K 1/50* (2013.01); *B41K 1/56* (2013.01); *B41K 1/58* (2013.01)

USPC ..... 101/405; 101/29; 101/42; 101/406

(58) Field of Classification Search

USPC ..... 101/405, 406, 29, 41, 42, 28

See application file for complete search history.

(56) References Cited

U.S. PATENT DOCUMENTS

| | | | | |
|---|---|---|---|---|
| 2,109,253 | A * | 2/1938 | Kolstad | 101/28 |
| 2,819,668 | A * | 1/1958 | McAneny | 101/125 |
| 3,388,662 | A * | 6/1968 | Ravreby | 101/405 |
| 3,490,370 | A * | 1/1970 | Pfannenschwarz | 101/381 |
| 5,313,885 | A | 5/1994 | Winston | |
| 5,579,692 | A | 12/1996 | Collier | |
| 6,244,180 | B1 * | 6/2001 | Winston | 101/405 |
| 6,415,714 | B2 | 7/2002 | Winston | |

* cited by examiner

*Primary Examiner* — Matthew G Marini

(74) *Attorney, Agent, or Firm* — Dale J. Ream

(57) ABSTRACT

A sock identification kit includes a housing configured to secure a plurality of ink stamps, a stamp holding device, at least one ink well, and a cleaning member. The stamp holding device includes a handle, actuation assembly, and a pair of clamping members that may be selectively actuated to move the clamping members between open and closed configurations. Accordingly, a selected stamp may be securely removed from the housing, used to imprint ink upon a fabric, and then replaced without ever touching a potentially ink stained stamp with one's hand.

12 Claims, 5 Drawing Sheets

SOCK IDENTIFICATION KIT

CROSS REFERENCE TO RELATED APPLICATION

This non-provisional patent application claims the benefit of provisional application Ser. No. 61/370,204 filed on Aug. 3, 2010, titled Sock Identification Kit.

BACKGROUND OF THE INVENTION

This invention relates generally to stamping and ink impression devices and, more particularly, to a kit for holding a stamp holding device and a plurality of stamps.

Sorting laundry—especially socks—can be a very time consuming household chore as well as a task that is often done erroneously. For example, if respective left and right socks are not correctly matched, a person may wind up wearing socks that are different colors, have different patterns, or are even different sizes. A mother is often faced with the daunting task of correctly matching dozens of socks that, at first glance, appear to be the same but which may ultimately be different sizes and colors and belong to different members of a family.

Various devices have been proposed in the prior art for stamping fabric with ink so as to provide identifying markings to a person sorting the fabric articles. Although assumably effective for their intended purposes, the existing stamping devices require a user to touch the stamp and potentially get ink on their fingers, do not provide for convenient customization of a stamped impression, or do not provide for selective colorization of a stamped surface.

Therefore, it would be desirable to have a kit for stamping a fabric that satisfies the drawbacks or limitations of the existing devices and patent proposals.

SUMMARY OF THE INVENTION

A sock identification kit according to the present invention includes a housing configured to secure a plurality of ink stamps, a stamp holding device, at least one ink well, and a cleaning member. The stamp holding device includes a handle, actuation assembly, and a pair of clamping members that may be selectively actuated to move the clamping members between open and closed configurations. Accordingly, a selected stamp may be securely removed from the housing, used to imprint ink upon a fabric, and then replaced without ever touching a potentially ink stained stamp with one's hand.

Therefore, a general object of this invention is to provide a kit for stamping a fabric that enables matching socks to be marked for quick and easy matching after a laundering process.

Another object of this invention is to provide a kit for stamping a fabric, as aforesaid, that minimizes or even prevents a user from touching the ink being stamped upon the fabric.

Still another object of this invention is to provide a kit for stamping a fabric, as aforesaid, that may be used by children such that matching clothing such as socks may be matched in the future by children themselves.

Yet another object of this invention is to provide a kit for stamping a fabric, as aforesaid, that is easy to operate and inexpensive to produce.

A further object of this invention is to provide a kit for stamping a fabric, as aforesaid, that may be operated with a single hand.

A still further object of this invention is to provide a kit for stamping a fabric, as aforesaid, in which multiple ink stamps may be stored in a single housing for usage as needed or desired without undue risk of losing them.

Other objects and advantages of the present invention will become apparent from the following description taken in connection with the accompanying drawings, wherein is set forth by way of illustration and example, embodiments of this invention.

DESCRIPTION OF THE PREFERRED EMBODIMENT

Figure 1:
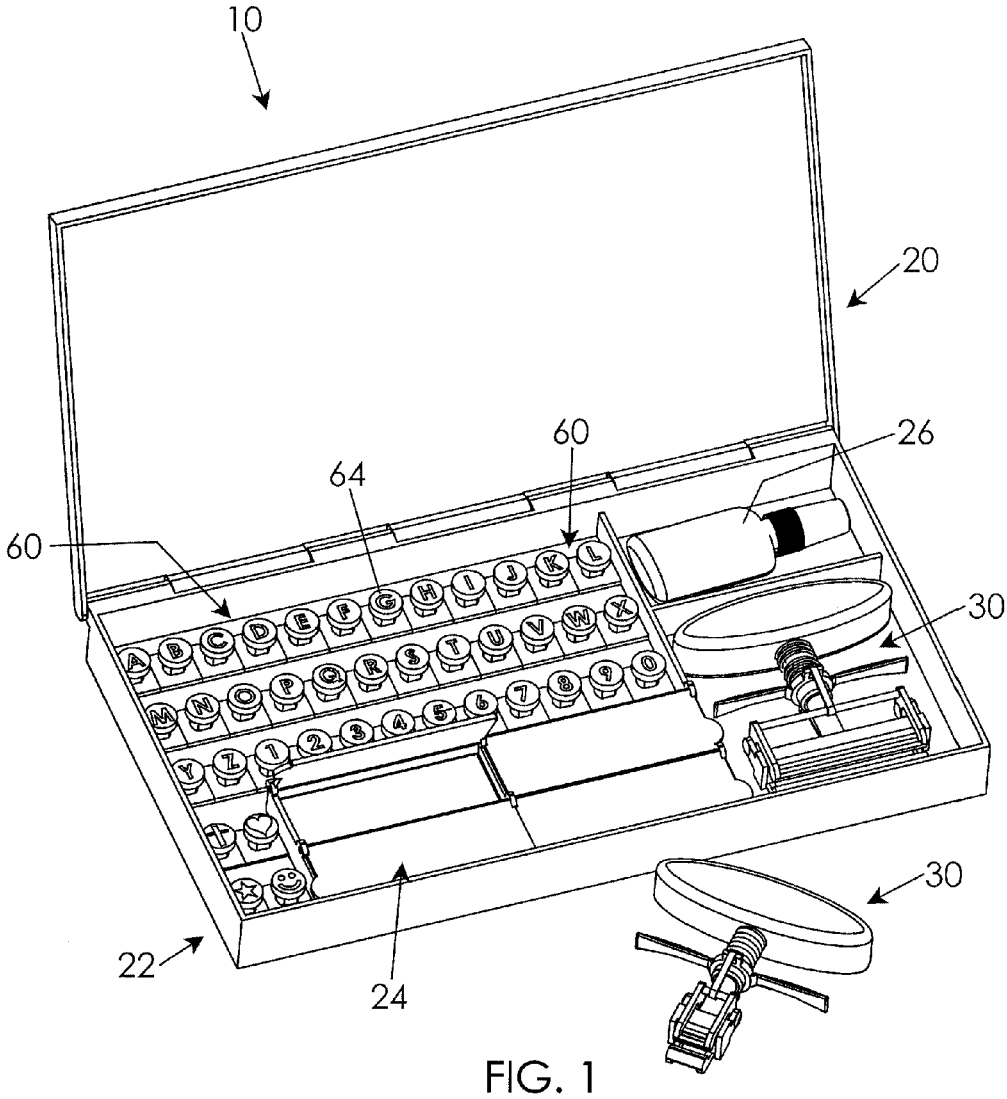
FIG. 1 is a perspective view of a kit for stamping a fabric according to a preferred embodiment of the present invention.

A kit for stamping a fabric material according to a preferred embodiment of the present invention will now be described in detail with reference to FIGS. 1 to 5*b* of the accompanying drawings. More particularly, the kit 10 includes a kit housing 20, a stamp holding device 30, a plurality of stamps 60, and at least one ink well 24.

The kit housing 20 includes a base member 22 having a bottom and a plurality of upstanding walls or divider members so as to receive respective components of the kit 10. For instance, upstanding walls may be configured to securely hold the stamp holding device 30, the plurality of stamps 60, at least one ink well 24, and a cleaning element 26, as will be further described below.

Figure 3:
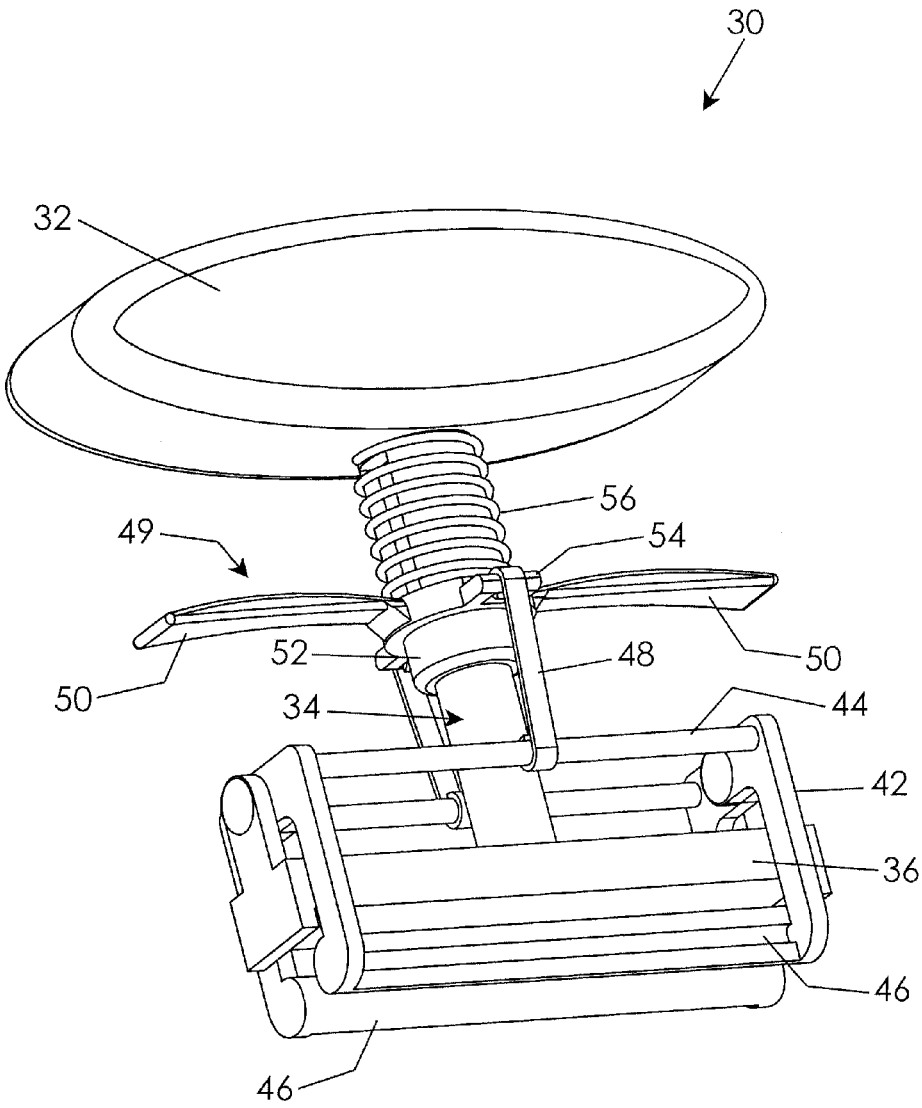
FIG. 3 is a perspective view on an enlarged scale of a stamp holding device removed from the kit housing as in FIG. 1.
Figure 4:
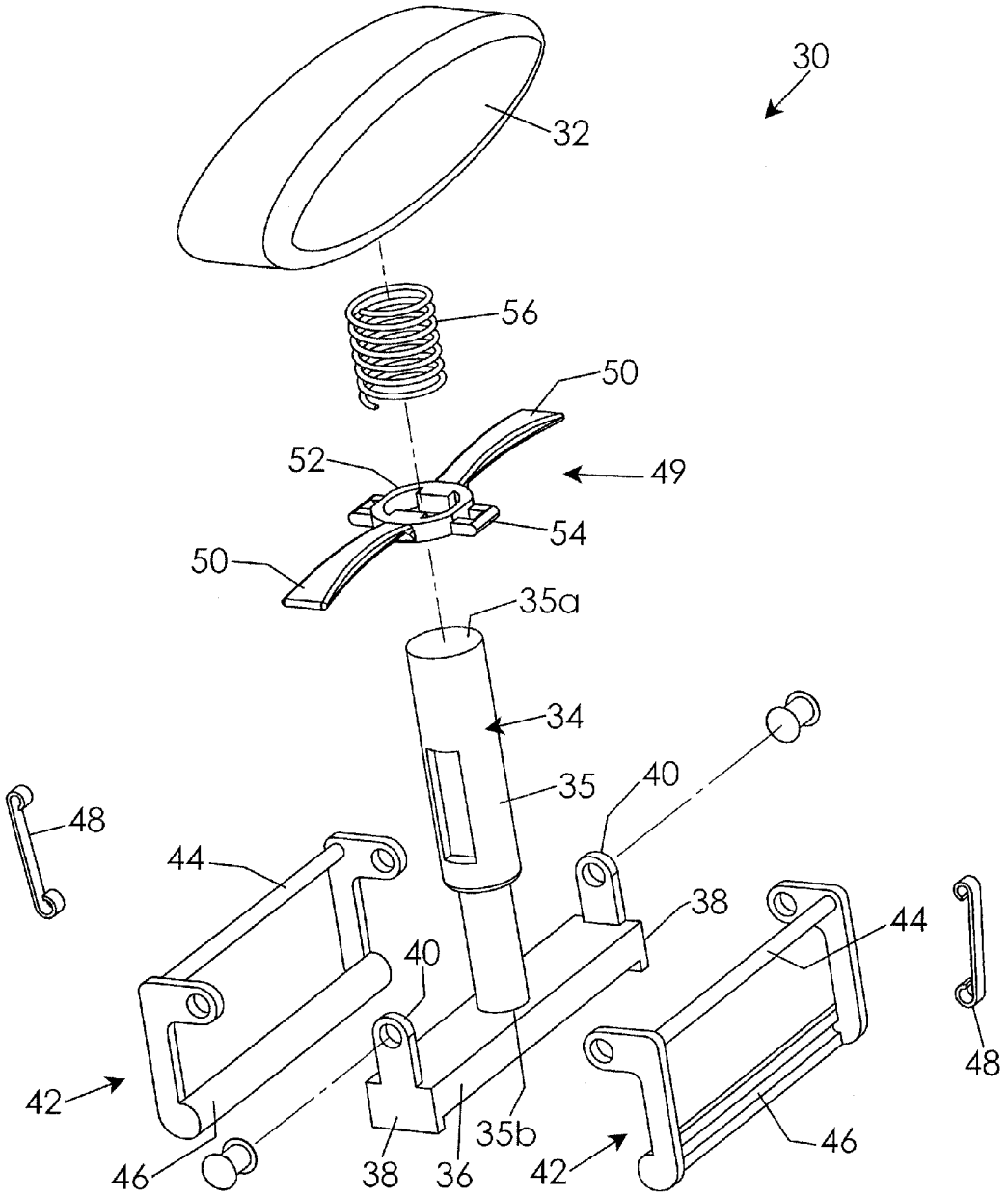
FIG. 4 is an exploded view of the stamp holding device as in FIG. 3.
Figure 5A:
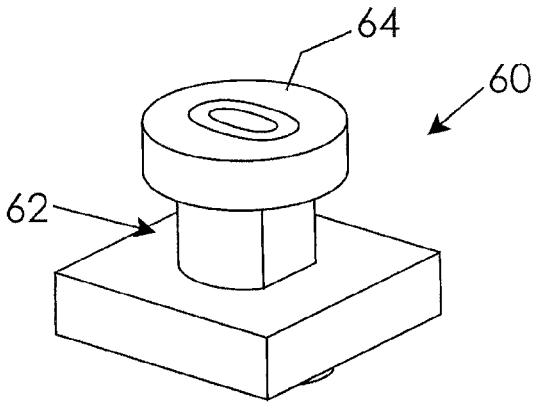
FIG. 5*a* is a perspective view of a stamp removed from the housing.
Figure 5B:
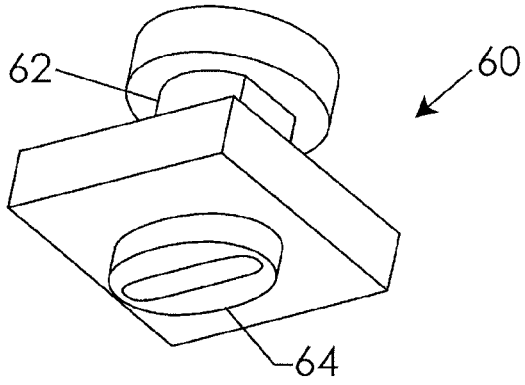
FIG. 5*b* is a perspective view of the stamp as in FIG. 5*a* taken from another angle.

A main component of the kit 10 is the stamp holding device 30 shown in FIGS. 3 and 4. The stamp holding device 30 is configured such that a user never has to physically touch any one of the plurality of stamps 60, as the stamps may become substantially covered in ink which would stain a user's fingers or clothes if touched. The stamp holding device 30 may include a handle 32, a main body member 34, a pair of clamping members 42, and a spring loaded linkage for actuating the clamping members 42. More particularly, the handle 32 preferably includes an ergonomic configuration that fits comfortably in the palm of person's hand such that the main body member 34 and pair of clamping members 42 may be operated with a single hand as will be described more fully below. The body member 34 preferably includes an upper portion 35 having a cylindrical configuration although other configurations would also work, the upper portion 35 having an upper end 35*a* attached to an underside of the handle 32 and depends therefrom.

The stamp holding device 30 includes an actuation assembly 49 having a pair of opposed actuation members 50 although a single actuation member may also work. The pair of opposed actuation members 50 are attached to the upper portion 35 of the body member 34 with a coupling 52 configured so that the actuation assembly 49 is movable along the upper portion 35 of the main body member 34 between upward and downward configurations. The pair of actuation members 50 extend away from the coupling 52 in opposed directions. The coupling 52 includes one or more flanges 54 extending outwardly from a radial edge thereof. A compression spring 56 is situated about the upper portion 35 of the body member 34 upwardly adjacent the actuation assembly 49 (i.e. between the actuation members 50 and the handle 32), the spring 56 normally biasing the actuation assembly 49 toward the downward configuration (FIG. 3).

The pair of clamping members 42 are pivotally coupled to a lower portion 36 of the body member 34. The lower portion 36 is generally perpendicular to the upper portion 35 of the main body member 34, is attached to a bottom end 35*b* of the upper portion 35, and includes opposed ends 38. Each end 38 includes a coupling element 40. Each clamping member 42 is pivotally attached to respective coupling elements 40. More particularly, each clamping member 42 includes an upper bar 44 and lower/clamping bar 46. It is understood that the body portion coupling elements 40 define a pivot axis about which the clamping members 42 are movable between open (FIG. 2*b*) and closed (FIG. 2*a*) configurations when actuated. A connection rod 48 extends between respective upper bars 44 and respective coupling flanges 54 for operatively connecting the actuation assembly 49 and coupling members 42. The connection rods 48 enable operation of the actuation assembly 49 to operate the clamping members 42 as described in more detail below.

As shown in FIGS. 2*a* to 2*d*, when a user pulls up on respective actuation members 50 (i.e. toward the upward configuration), the spring 56 is compressed, the connection rods 48 pull upwardly on respective upper bars 44 of respective clamping members 42, and the clamping members 42 pivot to an open configuration. Upon release of the actuation members 50, the spring 56 urges the clamping members 42 toward the closed configuration in an opposite manner. Preferably, the clamping members 42 are employed to grip one of the plurality of stamps 60 stored in the kit housing 20.

Figure 2A:
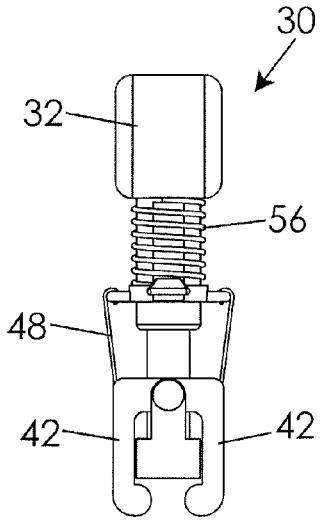
FIGS. 2*a* to 2*d* are front views of a stamp holder engaging a stamp taken from the kit as in FIG. 1 in various configurations of use.
Figure 2B:
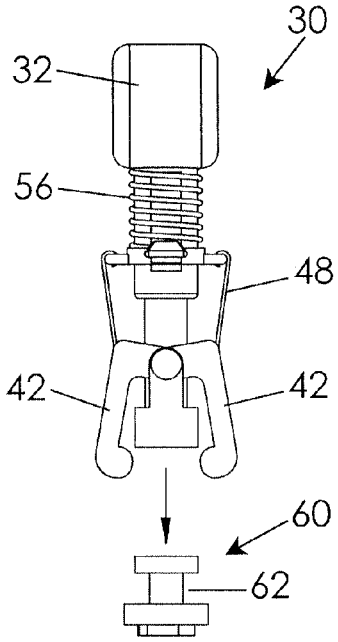
Figure 2C:
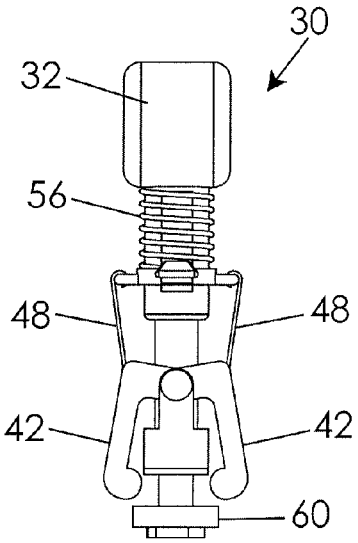
Figure 2D:
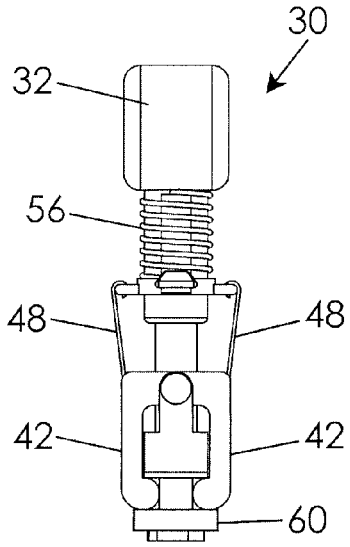

As best shown in FIG. 2*b*, an ink stamp 60 may include a generally cubical configuration having top and bottom surfaces connected by side walls. Preferably, at least one side wall defines and indentation 62 or equivalent configuration that is complementary to a configuration of respective lower bars 46 of respective clamping members 42 such that the clamping members 42 are able to securely clamp thereto as described above. It is understood that each top surface may include indicia 64, such as print indicia, identifying an associated configuration on the bottom surface thereof, such as a typeset configuration. In other words, a user may look into the housing 20 and select a desired stamp 60 according to top surface indicia 64, knowing that an associated indicia is on the bottom of that stamp. The indicia may be alphanumeric indicia, special pictures or characters, or the like.

Each ink well 24 preferably stores ink of a color different from that of each other ink well 24. In addition, the cleaning element 26 may be a solution formulated to clean the bottom surface of a stamp 60 prior to use. Alternatively, the cleaning element 26 may be a pad or brush (not shown) configured to clean either a stamp bottom surface or a surface prior to imprinting upon it.

In use, the stamp holding device 30 may be operated to clamp onto a selected stamp 60 as described above, e.g. a letter representing a person's initial. Then a stamp bottom surface may be dipped into a selected color of ink and then imprinted onto an article of fabric, such as a sock, all without ever having to touch the stamp itself or come into contact with the ink. The bottom of the stamp 60 may be cleaned using the cleaning element 26 and then released back into the housing 20 by again operating the actuation assembly 49 of the stamp holding device 30.

It is understood that while certain forms of this invention have been illustrated and described, it is not limited thereto except insofar as such limitations are included in the following claims and allowable functional equivalents thereof.

The invention claimed is:

1. An ink stamping kit, comprising:

a stamp holding device including:

a main body member having opposed upper and lower portions;

an actuation assembly attached to said upper portion of said main body member with a coupling configured so that said actuation assembly is selectively movable between upward and downward configurations along said upper portion of said main body member;

a compression spring coupled to said upper portion of said main body member upwardly adjacent to said actuation assembly, said spring normally biasing said actuation assembly toward said downward configuration;

a pair of clamping members pivotally coupled to said lower portion of said body member and operatively connected to said actuation assembly so as to be movable between an open configuration when said actuation assembly is at said upward configuration and a closed configuration when said actuation assembly is at said downward configuration;

a plurality of ink stamps, each stamp having a configuration complementary to a configuration of said clamping members so as to be selectively captured by said pair of clamping members at said closed configuration and to be released from said pair of clamping members at said open configuration;

a housing having a bottom and a plurality of divider members configured to receive said stamp holding device and said plurality of ink stamps;

a handle attached atop said upper portion of said main body member such said spring is positioned intermediate said handle and said actuation assembly, said spring being compressed against said handle when said actuation assembly is moved toward said upward configuration;

wherein said actuation assembly includes:

a pair of opposed actuation members coupled to said upper portion of said main body member with said actuation assembly coupling, said actuation members extending away from said actuation assembly coupling in opposite directions;

a pair of flanges extending outwardly from said actuation assembly coupling; and a connection rod extending between respective flanges and respective clamping members such that an upward movement of said actuation members urges said clamping members toward said open configuration.

2. The ink stamping kit as in claim 1, wherein said lower portion of said main body member is generally perpendicular to said upper portion of said main body member and include opposed ends, each end having a coupling element attached thereto.

3. The ink stamping kit as in claim 2, wherein:

each clamping member is pivotally coupled to a respective coupling element of said upper portion of said main body;

each clamping member includes an upper bar and a lower clamping bar;

said coupling elements define a pivot axis about which each clamping member is movable between said open and closed configurations when actuated;

said connection rods extend between respective clamping member upper bars and respective coupling flanges.

4. The ink stamping kit as in claim 1, wherein each ink stamp includes:

top and bottom surfaces connected by side walls, said side walls defining configurations complementary to configurations of respective clamping member lower clamping bars such that said clamping members securely attach thereto when at said closed configuration; and said top surface having print indicia indicative of an associated typeset configuration on said bottom surface.

5. The ink stamping kit as in claim 4, wherein said print and typeset indicia are alphanumeric indicia.

6. The ink stamping kit as in claim 4, wherein said print and typeset indicia are special character indicia.

7. The ink stamping kit as in claim 4, wherein each ink stamp includes a configuration that is securable between said clamping members without being touched by a user's hands.

8. The ink stamping kit as in claim 7, wherein said housing includes a configuration such that each ink stamp may be selectively removed from and replaced by said clamping members without being touched by a user's hands.

9. The ink stamping kit as in claim 1, wherein said housing includes at least one ink well situated between respective said divider members, each ink well including ink having a color different from a color of any other ink well.

10. The ink stamping kit as in claim 1, wherein said handle includes an ergonomic configuration such that said handle and said actuation assembly may be operated with a single hand of a user.

11. The ink stamping kit as in claim 1, wherein said housing includes a configuration to receive a cleaning element, said cleaning element being one of a solution, brush, or pad configured to clean a stamp bottom surface prior to or after use.

12. The ink stamping kit as in claim 1, wherein said housing includes a lid pivotally coupled to said bottom and configured to move selectively between an open configuration exposing said stamp holding device and said plurality of ink stamps and a closed configuration covering said stamp holding device and said plurality of ink stamps.

* * * * *